US008747262B1

(12) United States Patent
Lin et al.

(10) Patent No.: US 8,747,262 B1
(45) Date of Patent: Jun. 10, 2014

(54) JOINTED BAT

(71) Applicants: Hung-Wen Lin, Taichung (TW); Ping-Hsueh Li, Xizhou Township, Changhua County (TW)

(72) Inventors: Hung-Wen Lin, Taichung (TW); Ping-Hsueh Li, Xizhou Township, Changhua County (TW)

( * ) Notice: Subject to any disclaimer, the term of this patent is extended or adjusted under 35 U.S.C. 154(b) by 71 days.

(21) Appl. No.: 13/685,225

(22) Filed: Nov. 26, 2012

(51) Int. Cl.
*A63B 59/06* (2006.01)

(52) U.S. Cl.
USPC ..... 473/566; 473/567

(58) Field of Classification Search
CPC .... A63B 59/00; A63B 59/06; A63B 59/0014; A63B 59/0059; A63B 59/0088; A63B 59/0092; A63B 2209/02; A63B 2209/00; A63B 2209/023; A63B 49/06; A63B 2069/0008; A63B 2059/00; A63B 2059/06; A63B 2059/0014; A63B 2059/065
USPC ..... 473/457, 519, 520, 564–568
See application file for complete search history.

(56) References Cited

U.S. PATENT DOCUMENTS

| | | | | | |
|---|---|---|---|---|---|
| 59,313 | A * | 10/1866 | Hill | 473/564 |
| 795,815 | A * | 8/1905 | Burrows | 473/564 |
| 4,714,251 | A * | 12/1987 | Cook | 473/564 |
| 6,609,984 | B1 * | 8/2003 | Tribble | 473/564 |
| 6,824,482 | B1 * | 11/2004 | Tribble | 473/564 |
| 6,949,038 | B2 * | 9/2005 | Fritzke | 473/566 |
| 7,381,141 | B2 * | 6/2008 | Van Nguyen | 473/566 |
| 8,226,505 | B2 * | 7/2012 | Burger | 473/520 |
| 8,313,397 | B2 * | 11/2012 | Watari et al. | 473/564 |
| 2004/0224802 | A1 * | 11/2004 | Forsythe et al. | 473/564 |
| 2005/0003913 | A1 * | 1/2005 | Guenther et al. | 473/564 |
| 2005/0059515 | A1 * | 3/2005 | Chang | 473/564 |
| 2006/0252586 | A1 * | 11/2006 | Nguyen | 473/564 |
| 2006/0293129 | A1 * | 12/2006 | Kobayashi | 473/564 |
| 2007/0155546 | A1 * | 7/2007 | Chauvin et al. | 473/520 |
| 2007/0191156 | A1 * | 8/2007 | Van Nguyen | 473/564 |
| 2007/0202973 | A1 * | 8/2007 | Van Nguyen | 473/564 |
| 2008/0058132 | A1 * | 3/2008 | Nguyen | 473/564 |
| 2008/0064538 | A1 * | 3/2008 | McNamee et al. | 473/564 |
| 2010/0087282 | A1 * | 4/2010 | Smith | 473/566 |
| 2010/0113194 | A1 * | 5/2010 | Tokieda | 473/566 |
| 2011/0086734 | A1 * | 4/2011 | Chung | 473/567 |
| 2012/0108371 | A1 * | 5/2012 | Epling et al. | 473/566 |

* cited by examiner

*Primary Examiner* — Mark Graham
(74) *Attorney, Agent, or Firm* — Muncy, Geissler, Olds & Lowe, P.C.

(57) ABSTRACT

A jointed bat includes a barrel, a handle, and a glue. The barrel is tubular and has one end fixedly connected to a top cap and the other end having a tapered first joint portion. An opening is formed at the end of the first joint portion. The handle is tubular and has one end fixedly connected to a knob and the other end having a tapered resilient second joint portion. At least a relief slit is formed at an end of the second joint portion. A dam protrudes from the second joint portion and abuts against an inner wall of the first joint portion. The second joint portion penetrates the opening to fit inside the first joint portion. The glue is filled between and fixedly connected between the first and second joint portions. Therefore, requirements for precision in production of the barrel and the handle are reduced.

7 Claims, 7 Drawing Sheets

JOINTED BAT

BACKGROUND OF THE INVENTION

1. Technical Field

The present invention relates to bats, and more particularly, to a jointed bat.

2. Description of Related Art

In general, a conventional jointed bat essentially comprises a barrel and a handle. The barrel and the handle each have a tapered joint portion. A glue is filled between the joint portion of the handle and the joint portion of the barrel, such that the two joint portions are fixed to each other to finalize the manufacturing process of the jointed bat.

However, the conventional jointed bat has drawbacks in terms of its production and operation. As for the production of the conventional jointed bat, it is required that the joint portion of the barrel and the joint portion of the handle of the conventional jointed bat have to be precisely produced, because a gap between the joint portion of the barrel and the joint portion of the handle has to be consistent in size in order to be filled with a glue. If the gap is too small or if the joint portions abut against each other, the glue cannot fill the gap, and in consequence the barrel and the handle cannot be jointed together firmly. Also, considerations must be given to the coaxiality between the barrel and the handle so as to meet the requirements of product quality. Hence, there are strict requirements for precision and tolerance of the dimensions of the joint portion of the barrel and the joint portion of the handle, which add to the costs incurred and difficulties encountered in the manufacturing process of the conventional jointed bat.

Furthermore, an old conventional jointed bat is likely to generate noise. It is because although a gap is provided between the joint portion of the barrel and the joint portion of the handle and filled with a glue, the gap is not equipped with any dam. Hence, the cured glue is likely to detach under the vibration of the old conventional jointed bat in operation, and the glue thus detached hits the inner wall of the barrel and therefore generates noise.

SUMMARY OF THE INVENTION

It is an objective of the present invention to provide a jointed bat conducive to reduction of the requirements for the precision of the production of the joint portion and prevention of glue detachment.

In order to achieve the above and other objectives, the present invention provides a jointed bat, comprising: a barrel being tubular, having one end fixedly connected to a top cap, and having another end having a tapered first joint portion, wherein an opening is formed at a terminal of the first joint portion; a handle being tubular, having one end fixedly connected to a knob, and having another end having a second joint portion which is tapered and resilient, wherein at least a relief slit is formed at a periphery of an end of the second joint portion, wherein a dam protrudes from the second joint portion and abuts against an inner wall of the first joint portion, wherein the second joint portion penetrates the opening to fit inside the first joint portion; and a glue filled between the first joint portion and the second joint portion and fixedly connected to the first joint portion and the second joint portion.

The jointed bat is characterized in that the dam ensures the gap between the first joint portion and the second joint portion to allow the glue to be fixedly connected to the first joint portion and the second joint portion and thereby reduce the chance of glue detachment which otherwise causes the generation of noise. Furthermore, in the step of adjusting the coaxiality between the barrel and the handle during the manufacturing process, due to the relief slit, the dam can abut against the inner wall of the first joint portion at different positions to thereby reduce the requirements for the precision in the production of the barrel and the handle and cut manufacturing costs.

BRIEF DESCRIPTION OF THE SEVERAL VIEWS OF THE DRAWINGS

Structures and features of the present invention are hereunder illustrated with specific embodiments in conjunction with the accompanying drawings, in which.

DETAILED DESCRIPTION OF THE EMBODIMENTS OF THE INVENTION

Figure 1:
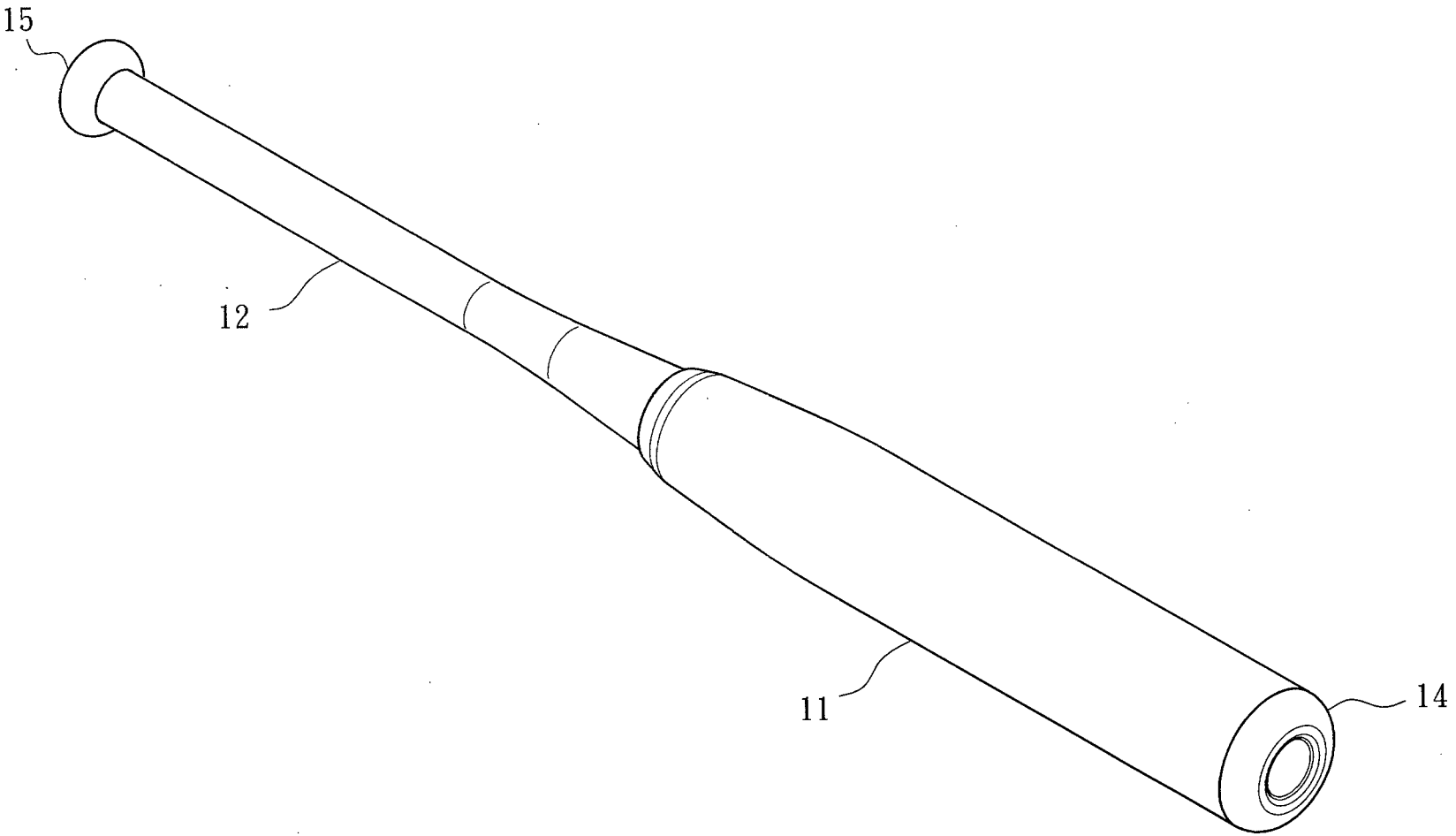
FIG. 1 is a perspective view of a jointed bat according to the first preferred embodiment of the present invention.
Figure 2:
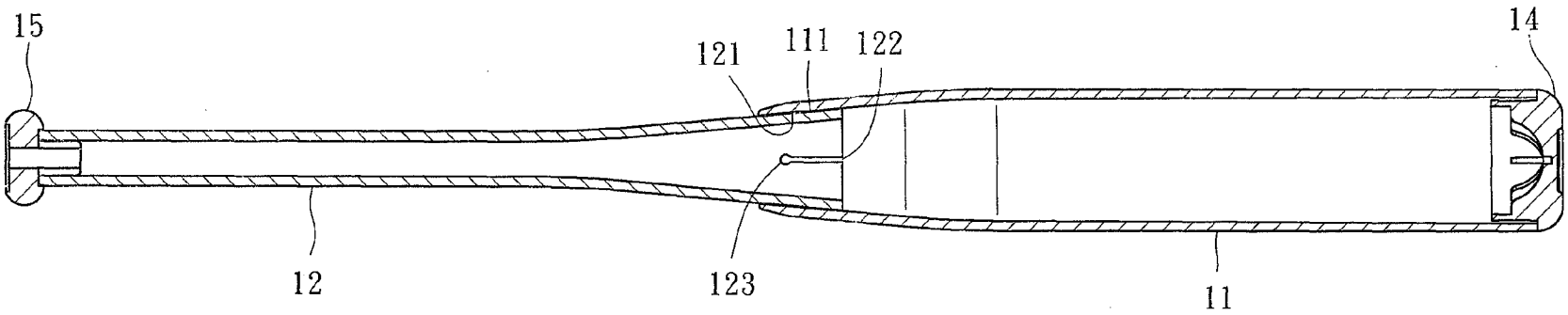
FIG. 2 is a cross-sectional view of the jointed bat according to the first preferred embodiment of the present invention.
Figure 3:
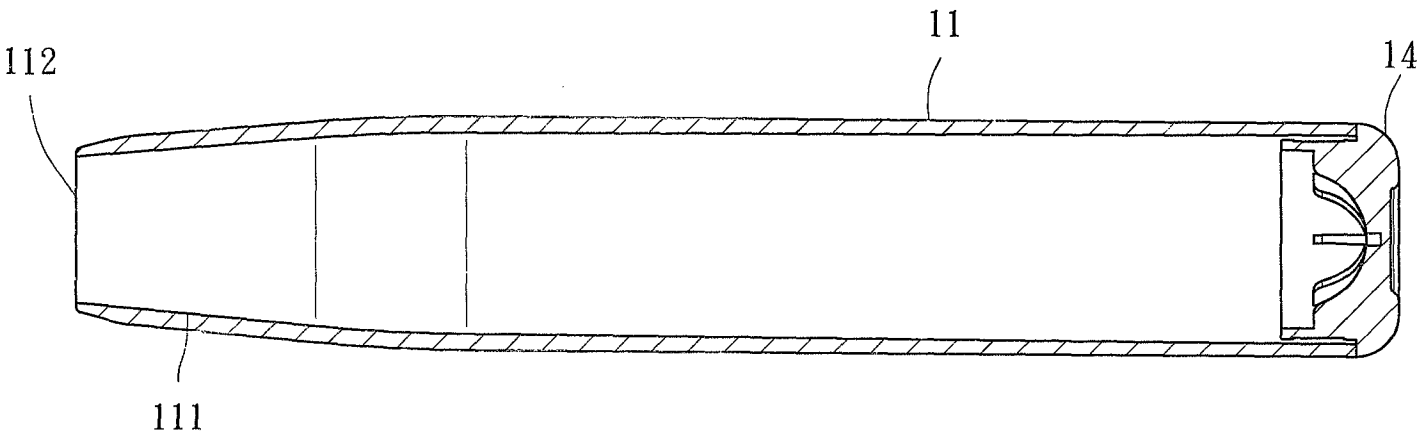
FIG. 3 is a cross-sectional view of a barrel of the jointed bat according to the first preferred embodiment of the present invention.
Figure 4:
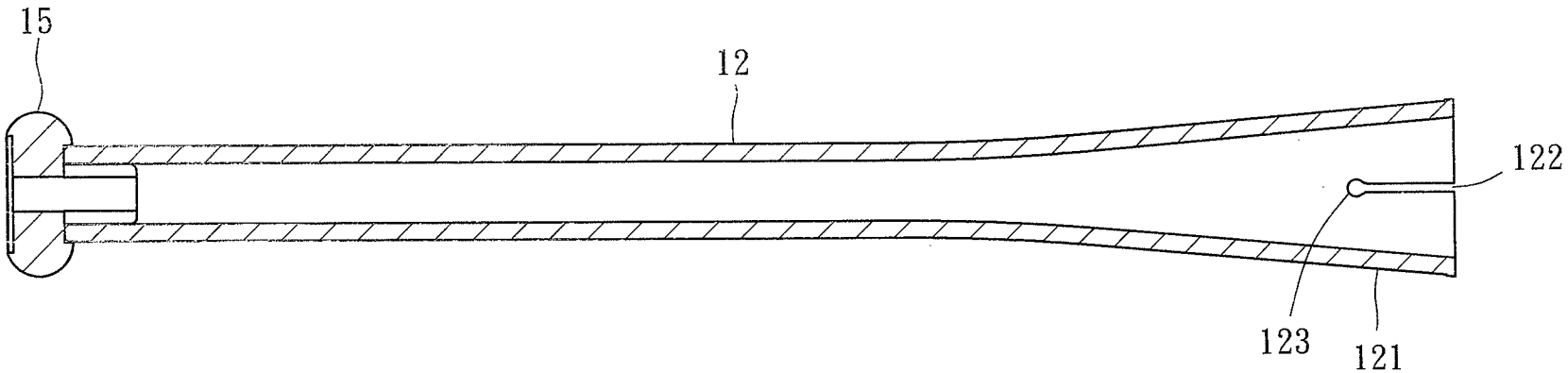
FIG. 4 is a cross-sectional view of a handle of the jointed bat according to the first preferred embodiment of the present invention.
Figure 5:
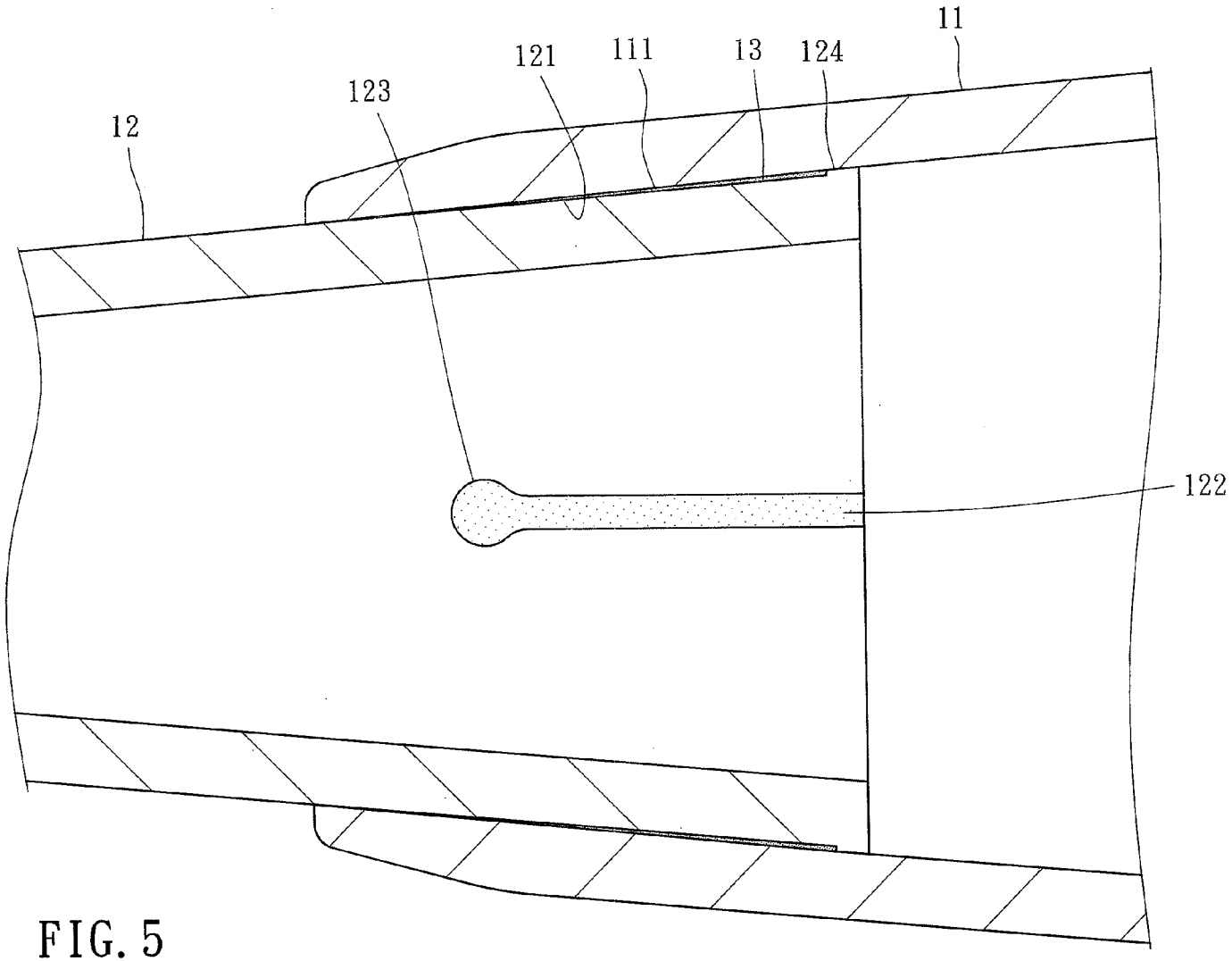
FIG. 5 is a partial cross-sectional view of the jointed bat according to the first preferred embodiment of the present invention.

Referring to FIG. 1 through FIG. 5, the present invention provides a jointed bat which essentially comprises a barrel 11, a handle 12, and a glue 13.

The barrel 11 is tubular. The barrel 11 has one end fixedly connected to a top cap 14, and has the other end having a tapered first joint portion 111. An opening 112 is formed at the terminal of the first joint portion 111.

The handle 12 is tubular. The handle 12 has one end fixedly connected to a knob 15, and has the other end having a second joint portion 121 which is tapered and resilient. At least a relief slit 122 is formed at the periphery of an end of the second joint portion 121. This preferred embodiment is exemplified by one said relief slit 122. In this preferred embodiment, the relief slit 122 has a round trough 123 for preventing stress concentration which otherwise causes a crack. A dam 124 protrudes from the surface of the second joint portion 121. The dam 124 abuts against an inner wall of the first joint portion 111. The second joint portion 121 penetrates the opening 112 to fit inside the first joint portion 1111.

The glue 13 is filled between the first joint portion 111 and the second joint portion 121 and fixedly connected to the first joint portion 111 and the second joint portion 121.

Therefore, the dam 124 not only ensures the integrity of the gap between the first joint portion 111 and the second joint portion 121, but also enables the glue 13 to fill the gap and thereby connect the first joint portion 111 and the second joint portion 121 firmly. Furthermore, the dam 124 reduces the chance that the glue 13 detaches while the bat is moving. In addition, in the step of adjusting the coaxiality between the barrel 11 and the handle 12 during the manufacturing process, due to the relief slit 122, the dam 124 can abut against the inner wall of the first joint portion 111 at different positions to thereby reduce the requirements for the precision in the production of the barrel 11 and the handle 12 and cut manufacturing costs.

Figure 6:
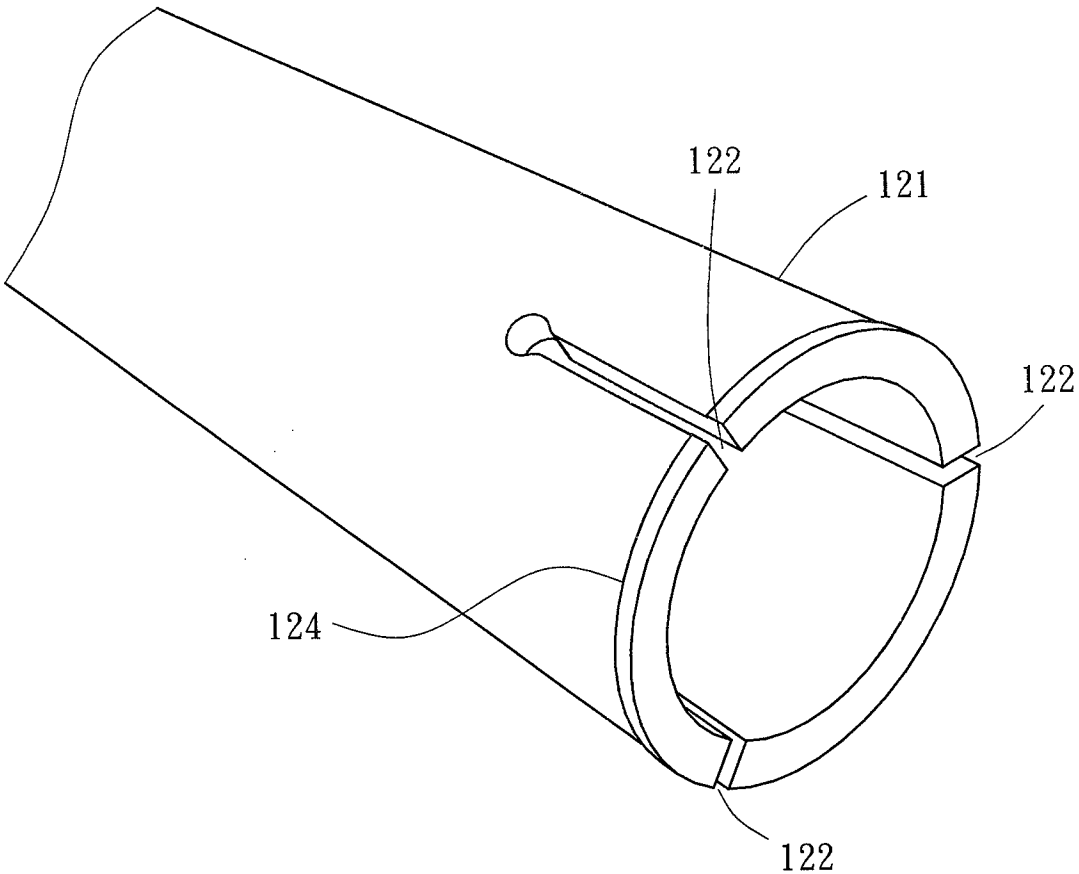
FIG. 6 is a perspective view of a portion of the handle according to the second preferred embodiment of the present invention, showing that relief slits penetrate a dam.

Referring to FIG. 6, there is shown a perspective view of a portion of the handle according to the second preferred embodiment of the present invention, showing that relief slits penetrate a dam. The second preferred embodiment is different from the first preferred embodiment in that, in the second preferred embodiment, the relief slit 122 comes in plurality. The second preferred embodiment is exemplified by three said relief slits 122 which are equidistantly disposed around the second joint portion 121. The trough of each of the relief slits 122 has to be spaced apart from the opening 112 by a predetermined distance to reduce the chance that the relief slits 122 are exposed from the opening 112 during the operation of the bat. During the actual manufacturing process of the jointed bat, the aforesaid distance has to be longer than 1 cm, preferably. As for the thickness of the dam 124, during the actual manufacturing process of the jointed bat, the dam 124 is preferably thinner than 3 mm. In doing so, the glue 13 can fill the gap between the first joint portion 111 and the second joint portion 121.

Figure 7:
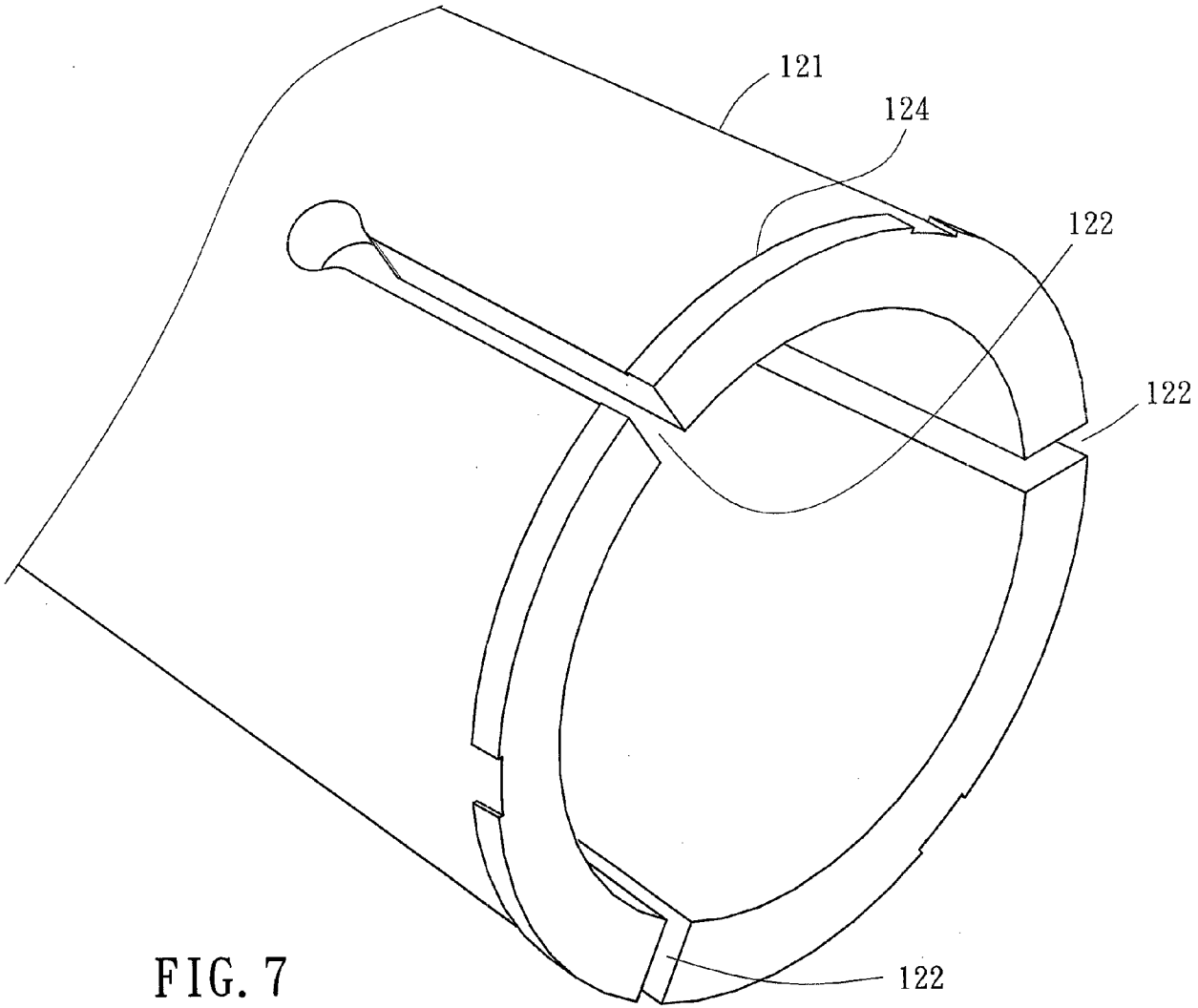
FIG. 7 is a perspective view of a portion of the handle according to the second preferred embodiment of the present invention, showing that the dam is disposed at a second joint portion and is characterized by interrupted continuity.

Referring to FIG. 7, in the first preferred embodiment and the second preferred embodiment, the dam 124 encloses the second joint portion 121 and is penetrated by the relief slits 122. Alternatively, the dam 124 does not enclose the second joint portion 121 but features interrupted continuity when disposed at the second joint portion 121. Preferably, the dam 124 encloses the second joint portion 121.

What is claimed is:

1. A jointed bat, comprising:

a barrel being tubular, having one end fixedly connected to a top cap, and having another end having a tapered first joint portion, wherein an opening is formed at a terminal of the first joint portion;

a handle being tubular, having one end fixedly connected to a knob, and having another end having a second joint portion which is tapered and resilient, wherein at least a relief slit is formed at a periphery of an end of the second joint portion, wherein a dam protrudes from the second joint portion and abuts against an inner wall of the first joint portion, wherein the second joint portion penetrates the opening to fit inside the first joint portion; and a glue filled between the first joint portion and the second joint portion and fixedly connected to the first joint portion and the second joint portion.

2. The jointed bat of claim 1, wherein the at least a relief slit has a round trough for preventing stress concentration which otherwise causes a crack.

3. The jointed bat of claim 2, wherein the at least a relief slit comes in plurality to be equidistantly disposed around the second joint portion.

4. The jointed bat of claim 1, wherein the dam is less than 3 mm thick.

5. The jointed bat of claim 1, wherein the dam encloses the second joint portion.

6. The jointed bat of claim 5, wherein the at least a relief slit penetrates the dam.

7. The jointed bat of claim 1, wherein the dam is disposed at the second joint portion and characterized by interrupted continuity.

* * * * *